US005192377A

United States Patent [19]

Prinz et al.

[11] Patent Number: 5,192,377

[45] Date of Patent: Mar. 9, 1993

[54] PROCESS OF PRODUCING CONTINUOUSLY CAST MONOTECTIC ALUMINUM-SILICON ALLOY STRIP AND WIRE

[75] Inventors: Bruno Prinz, Oberursel; Alberto Romero; Ingrid Müller, both of Frankfurt am Main, all of Fed. Rep. of Germany

[73] Assignee: Metallgesellschaft Aktiengesellschaft, Frankfurt, Fed. Rep. of Germany

[21] Appl. No.: 689,413

[22] Filed: Apr. 22, 1991

[30] Foreign Application Priority Data

May 5, 1990 [DE] Fed. Rep. of Germany ..... 4014430

[51] Int. Cl.[5] ..... C22C 21/02; C22C 21/04; C22C 11/08; C22C 12/00

[52] U.S. Cl. ..... 148/551; 148/552; 148/437; 148/538; 148/442; 420/548; 420/563; 420/577; 420/580

[58] Field of Search ..... 148/2, 11.5 R, 11.5 A, 148/437, 551, 552, 538, 442

[56] References Cited

U.S. PATENT DOCUMENTS 4,859,252 8/1989 Masumoto et al. ..... 148/437

FOREIGN PATENT DOCUMENTS 0271470 9/1989 Fed. Rep. of Germany ..... 148/2

OTHER PUBLICATIONS

"Dictionary of Engineering and Technology", Dr.-Ing. Richard Ernst, vol. 1, Fifth Edition, 1989, p. 1136.

*Primary Examiner*—Upendra Roy
*Assistant Examiner*—Sikyin Ip
*Attorney, Agent, or Firm*—Sprung Horn Kramer & Woods

[57] ABSTRACT

In a process of producing strip or wire, which consists of a monotectic aluminum-silicon alloy comprising a matrix consisting of aluminum and an aluminum-silicon eutectic system and as a minority phase 1 to 50% by weight lead or bismuth included in said matrix, which strip or wire has been continuously cast at a high casting velocity and a high cooling rate from a molten material which has been heated to a temperature above the segregation temperature, and which strip or wire has been subjected to plastic deformation and to a heat treatment, the minority phase which is embedded in the form of elongate platelets in the strip or wire is transformed to more compact shapes by a heat treatment at temperatures of 550° to 600° C.

5 Claims, 1 Drawing Sheet

PROCESS OF PRODUCING CONTINUOUSLY CAST MONOTECTIC ALUMINUM-SILICON ALLOY STRIP AND WIRE

BACKGROUND OF THE INVENTION

This invention relates to a process of producing strip or wire, which consists of a monotectic aluminum-silicon alloy comprising a matrix consisting of aluminum and an aluminum-silicon eutectic system and 1 to 50% by weight lead or bismust included in said matrix, which strip or wire has been continuously cast at a high casting velocity and a high cooling rate from a molten material which has been heated to a temperature above the segregation temperature, and which strip or wire has been subjected to plastic deformation and to a heat treatment.

When molten monotectic alloys in which the densities of the segregated liquid phases differ greatly and which have a large segregation temperature interval are heated to temperatures above the segregation temperature, gravitation will result at temperatures near the miscibility gap in a sedimentation and coagulation of the minority phase, which has a higher specific gravity and consists of droplets. In accordance with Stoke's law the sedimentation velocity is proportional to the square of the droplet diameter. For this reason, droplets which differ in diameter will promote the frequency at which droplet collisions and droplet amalgamations occur so that the sedimentation will be accelerated further. But a uniform dispersion of spherical particles which are small in diameter in the matrix of monotectic alloys can be achieved in that the molten material is continuously cast in a vertical direction at a relatively high casting velocity and a relatively high cooling rate to form a strip or wire which has a thickness or diameter from 5 to 20 mm so that a very steep temperature gradient is maintained before the solid-to-liquid phase boundary. As a result the difference between the segregation and solidus isotherms within the system and also the sedimentation path length will be as small as possible. The temperature interval and the path length interval are determined by the isotherms of the segregation temperature and by the temperature which is reached during the monotectic reaction and at which the matrix phase solidifies and as it solidifies includes the still liquid second phase in its then existing distribution. That process is particularly suitable for the production of cast strip and cast wire made of monotectic aluminum-silicon alloys which comprise a matrix consisting of aluminum and an aluminum-silicon eutectic system and 1 to 50% by weight lead or bismuth, which are included in said matrix as a minority phase consisting of fine droplets.

But the dimensions and/or the mechanical technological properties of such a cast structure often do not comply with the requirements set forth and for this reason the cast strip or the cast wire is subjected to a rolling treatment and/or a heat treatment in order to optimize the properties of the material. By the rolling of such a cast structure, the originally spherical lead or bismuth phase is deformed to constitute elongate platelets. But such elongate inclusions will adversely affect the mechanical load-carrying capacity and the technological properties of the material and for this reason a material having the desired properties cannot be produced unless the elongate platelets are transferred to compact structures; this may be effected by a succeeding heat treatment.

A conventional process for transforming and subsequently spheroidizing a disperse low-melting minority phase comprises the prolonged heating of the monotectic alloy to a temperature above the melting temperature of the low-melting minority phase. In that case the minority phase will be transformed and spheroidized by dissolving and transfer processes involving the matrix metal preferably within the molten phase because the solubilities and diffusion coefficients are much higher in molten materials than in solids.

The requirements set forth are not met by monotectic aluminum-silicon alloys, in which the low-melting liquid phases lead and bismuth are included in a matrix consisting of aluminum and an aluminum-silicon eutectic system because the solubilities of molten lead and molten bismuth in aluminum and also the diffusion coefficients of aluminum and silicon in lead and bismuth are very low so that a comparatively very long heat treatment will be required for a transformation and spheroidization of the minority phase consisting of lead and bismuth. The lead phase and the bismuth phase melt at temperatures of 330° and 270° C., respectively. Thereafter the aluminum-silicon eutectic system melts in a monotectic four-phase reaction at 570° and 580° C., respectively, and the aluminum matrix is finally melted.

It has been disclosed in the periodical Metall 36, No. 9/1982, pages 970 to 976, that in a monotectic aluminum-lead alloy a fine and uniform distribution of the lead phase, which is not soluble in solid aluminum and which consists of elongate filaments in the cast strip which has been rolled, can be achieved if tin is included in the aluminum-lead alloy. That measure will increase the solubility and will accelerate the diffusion of lead in aluminum. Because the presence of tin will strongly decrease the melting temperature of the lead, that measure of alloy technology cannot be adopted if the aluminum-lead-tin material will be subjected to thermal loads in use.

SUMMARY OF THE INVENTION

It is an object of the present invention so to treat the strip or wire which has been produced by the process described first hereinbefore and consists of a monotectic aluminum-silicon alloy composing a matrix and a lead phase or bismuth phase which is finely dispersed in that matrix that the lead phase or bismuth phase, which is insoluble in solid aluminum and which after the rolling operation consists of elongate platelets, are transformed to more compact shapes.

That object is accomplished in that the strip or wire is subjected to a heat treatment at a temperature of 550° to 600° C.

At said temperatures, the lead phase or bismuth phase will be melted and the aluminum-silicon eutectic system will also be melted at least in part. The transformation and spheroidization of the liquid lead phase or bismuth phase are effected very quickly within the eutectic melting ranges.

DETAILED DESCRIPTION OF THE INVENTION

According to a preferred feature the monotectic aluminum-silicon alloy which contains a lead phase that is included in the matrix of the alloy is subjected to a heat treatment at temperatures of 580° to 590° C.

The monotectic aluminum-silicon alloy which contains a bismuth phase that is included in the matrix of the alloy is heat-treated at temperatures of 575° to 585° C.

The heat treatment suitably takes 0.5 to 15 minutes.

During the rapid cooling the molten aluminum-silicon system will solidify very quickly and the silicon will form a distinctly coarser structure than in the as-cast state. That result is quite desirable because it will considerably improve the wear resistance of the material.

According to a further feature of the invention the molten material is cast at a velocity of 10 to 30 mm/s and is cooled at a rate of 300 to 1500 K/s.

The process in accordance with the invention is particularly suitable for the treatment of low-friction materials which contain aluminum and silicon and which in their matrix contain a finely dispersed lead phase or bismuth phase.

The invention will be explained more in detail hereinafter with reference to an example.

Figure 1:
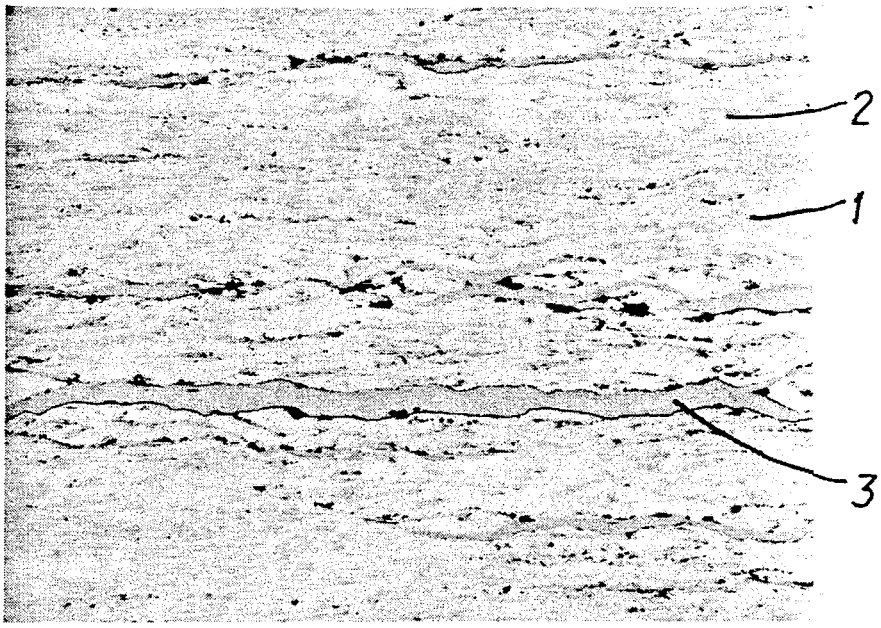
FIG. 1 is a micrograph of a section of a continuously cast and subsequently rolled strip of ternary monotectic aluminum alloy, silicon and bismuth composition.

FIG. 1 shows in a magnification of 500× magnification a micrograph of a polished section of a cast strip, which has been continuously cast in a thickness of 10 mm and has subsequently been rolled and consists of a ternary monotectic aluminum alloy that contains 5% silicon and 10% bismuth. As is apparent from the micrograph of the polished section, elongate platelets 3 of the bismuth phase are embedded in the matrix, which consists of aluminum 1 and of an aluminum-silicon eutectic system 2.

Figure 2:
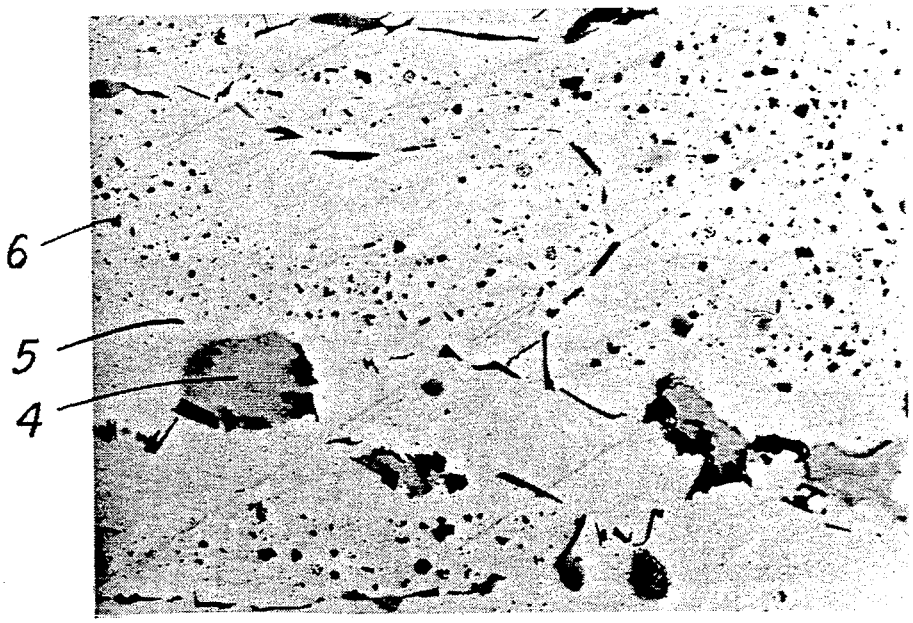
FIG. 2 is a micrograph of a section of a continuously cast and subsequently rolled and heated strip of ternary monotectic aluminum alloy, silicon and bismuth composition.

FIG. 2 is a micrograph showing in a magnification of 500 diameters a polished section of a cast strip which consists of the above-mentioned ternary monotectic aluminum alloy and has been continuously cast and subsequently rolled and has subsequently been heated at 587.5° C. for 5 minutes. It is apparent that the bismuth phase 4 has been spheroidized into the matrix 5, which consists substantially of aluminum, and that the silicon 6 has formed distinctly coarse crystals.

Wear resistance tests using the pin-disk method have shown that the ternary monotectic aluminum alloy in an as-rolled state has after a running time of 72 minutes a wear of 209 μm, which virtually constitutes a partial seizing. On the other hand, the wear of the cast strip which had been treated in accordance with the invention amounted only to 16 μm after a running time of 90 minutes.

We claim:

1. A process of producing strip or wire, which strip or wire consists of a monotectic aluminum-silicon alloy comprising a matrix consisting of aluminum, an aluminum-silicon eutectic system, and 1 to 50% by weight lead or bismuth as a phase, said process comprising heating the matrix to above the segregation temperature to form molten matrix, continuously casting the strip or wire at a high casting velocity and a high cooling rate from the molten matrix, then subjecting the strip or wire to a plastic deformation and then to a heat treatment at a temperature of 550° to 600° C.

2. The process according to claim 1, characterized in that the monotectic aluminum-silicon alloy which contains a lead phase that is included in the matrix of the alloy is subjected to a heat treatment at temperatures of 580° to 590° C.

3. The process according to claim 1, characterized in that the monotectic aluminum-silicon alloy which contains a bismuth phase included in the matrix of the alloy is subjected to a heat treatment at 575° to 585° C.

4. The process according to claim 1, characterized in that the heat treatment takes 0.5 to 15 minutes.

5. The process according to claim 1, characterized in that the molten material is cast at a velocity of 10 to 30 mm/s and is cooled at a rate of 300 to 1500 K/s.

* * * * *